United States Patent [19]

Simon

[11] Patent Number: 5,076,464

[45] Date of Patent: Dec. 31, 1991

[54] DEFORMABLE TUBULAR CONTAINER

[76] Inventor: Patrick Simon, 7 allée Théophile Gautier, 95140 Garges les Gonesse, Val d'Oise, France

[21] Appl. No.: 577,803

[22] Filed: Sep. 4, 1990

Related U.S. Application Data

[63] Continuation of Ser. No. 305,522, Feb. 29, 1989, abandoned.

[30] Foreign Application Priority Data

Feb. 23, 1988 [FR] France ..... 88 02110

[51] Int. Cl.[5] ..... B65D 35/24

[52] U.S. Cl. ..... 220/530; 215/6; 222/94

[58] Field of Search ..... 220/500, 85 B, 530; 206/219, 221, 277; 222/94, 107, 94; 215/6

[56] References Cited

U.S. PATENT DOCUMENTS

| | | | |
|---|---|---|---|
| 1,363,064 | 12/1920 | Stegath | 222/94 |
| 1,894,115 | 1/1933 | Murphy | 222/94 |
| 2,611,499 | 9/1952 | Mayer | 215/6 |
| 2,661,870 | 12/1953 | Huenergardt | 215/6 |
| 3,179,284 | 4/1965 | Valyi | 220/75 |
| 3,182,728 | 5/1965 | Zabriskie | 222/107 X |
| 3,197,671 | 7/1965 | Kuster | 215/6 |
| 3,269,389 | 8/1966 | Meurer | 215/6 |
| 3,335,912 | 8/1967 | Reeves, Jr. | 222/94 |
| 3,788,520 | 1/1974 | Dukess | 222/94 |
| 4,240,566 | 12/1980 | Bergmann | 215/6 |
| 4,258,863 | 3/1981 | Ness | 222/83 |
| 4,340,154 | 7/1982 | Van Manen | 222/94 |
| 4,528,180 | 7/1985 | Schaeffer | 424/52 |

FOREIGN PATENT DOCUMENTS

| | | | |
|---|---|---|---|
| 504275 | 12/1954 | Italy | 215/6 |

*Primary Examiner*—Steven M. Pollard

*Attorney, Agent, or Firm*—Browdy and Neimark

[57] ABSTRACT

The deformable tubular container includes at least one longitudinal corrugated, partition-forming sealed wall defining distinct compartments inside a tubular body. A portion at least of the wall which is at a level of a bottom portion of the body when expnded to eliminate the corrugations has a width equal to an inner half perimeter of the body and this wall is rigidly and tightly connected to an inner wall of the body by segments. to an inner wall of the body by segments. The bottom portion of the body being flattened and sealed against the fully expanded partition-forming wall to form a flattened sealed end of the tubular body.

5 Claims, 1 Drawing Sheet

DEFORMABLE TUBULAR CONTAINER

This is a continuation of copending application Ser. No. 07,305,522, filed on Feb. 9, 1989, now abandoned.

FIELD OF THE INVENTION

The present invention relates to tubular containers made of tubes of plastics material or the like.

BACKGROUND OF THE INVENTION

Known containers are often produced from a continuously extruded tube which is thereafter cut to length and to which there is adapted on one side a head forming a shoulder as well as a threaded ring or neck on which a closing plug is then put in position.

The container thus formed is provided with an opened bottom portion adapted, for filling the container, and the bottom portion is finally flattened closed and sealed by welding or crimping by using any known means of the art and adapted to the material constituent of the container.

In other embodiments, the head and body of the container are made of a single member by injection in a mold, and the container is as previously filled prior to closing its bottom portion.

For some applications and particularly for some body treatments with cosmetics products, as well as of other products, for example for two component glues or paints, it is necessary to have two containers and a particular packing for receiving these two containers so that the products of different natures that they contain should not be brought under any circumstances in contact together prior to their use.

OBJECTS AND SUMMARY OF THE INVENTION

The present invention provides a new tubular container which can contain at least two products without these two products being able to get mixed together prior to their use, and this without making more complex the production of the container made as a single element by an injection process.

According to a first object of the invention, the deformable tubular container includes at least one longitudinal corrugated, partition-forming wall defining distinct compartments inside a deformable tubular body, a portion at least of the wall which is at a level of a bottom portion of the body having a width equal to an inner half perimeter of said body when fully expanded to eliminate the corrugations and said wall being rigidly and tightly connected to an inner wall of said body by segments. The bottom portion of the body being flattened and sealed against the fully expanded partition-forming wall to form a flattened sealed end of the tubular body.

The invention is also applied to a method for producing the above container.

According to a second object of the invention, the method for producing as a single element a container including at least one inner longitudinal wall defining distinct compartments inside the deformable tubular body of the container, said container being produced by injection of a plastics material in a mold, comprises the steps of providing a core which is movable with respect to the mold, the core being formed with at least one longitudinal slit for formation of the longitudinal wall and with connection means for connecting slit portions of the core with the mold while preventing deformation thereof.

Various other features of the invention will become more apparent from the hereafter detailed description.

BRIEF DESCRIPTION OF THE DRAWINGS

An embodiment of the invention is shown, by way of a non limiting example, in the accompanying drawings, wherein.

DETAILED DESCRIPTION OF A PREFERRED EMBODIMENT

Figure 2:
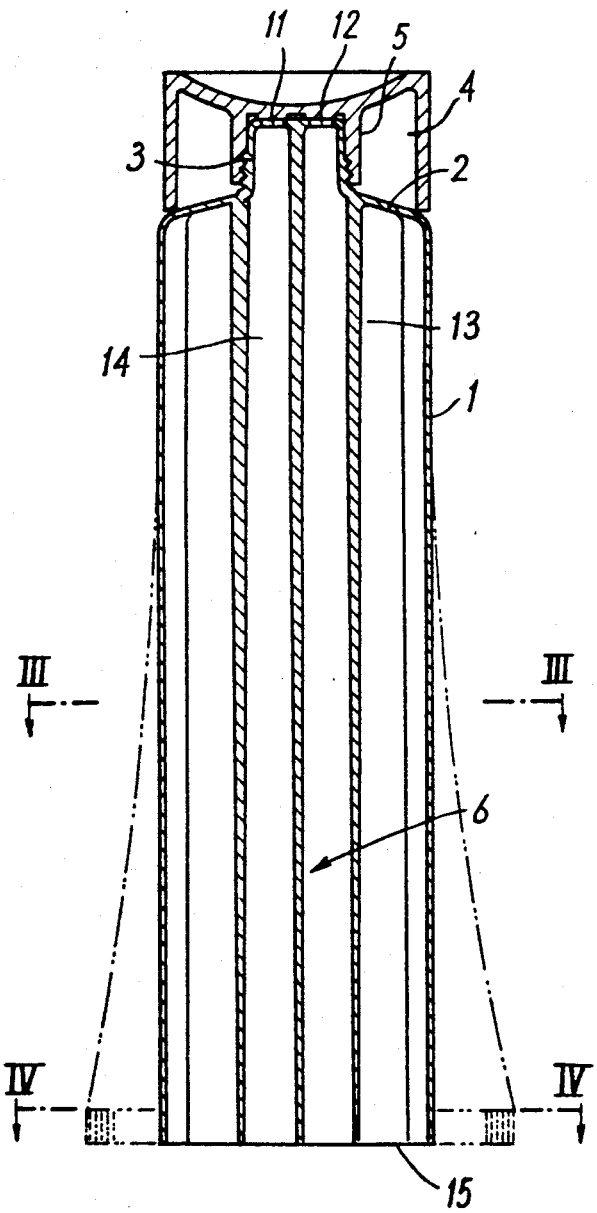
FIG. 2 is a cross-sectional view taken along line II—II of FIG. 1, the container being provided with a closing plug.
Figure 1:
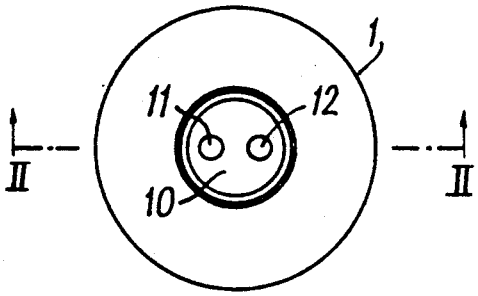
FIG. 1 is a view from above of a deformable tubular container of the invention.

The container shown in the drawings includes a tubular body 1 which is shown with a circular section, but which could possibly have another shape, for example an oval shape.

At its upper portion, the body 1 forms a shoulder 2 and a neck 3 adapted for receiving a closing plug 4. Connection means between the neck 3 and the closing plug 4 can be of any type.

In the example shown, the neck 3 is threaded, and the closing plug 4 includes inside a tapped skirt 5 screwed onto the neck 3.

The closing plug 4 could be maintained in a similar way by a snap-ring or by protrusions, or by any other means generally known in the art for closing containers.

Inside, the tubular body 1 is provided with a wall 6 which is corrugated or conformed in another way so that it has a developed length which is equal to half an inner perimeter of the body 1 when the body 1 is at rest.

Figure 3:
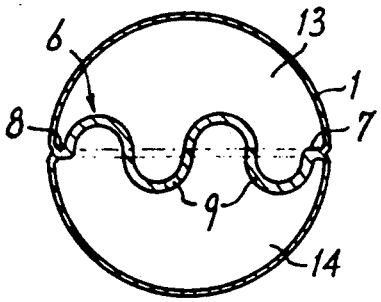
FIG. 3 is a cross-sectional view taken along line III—III of FIG. 2.

It is advantageous, as shown particularly in FIG. 3, that the wall 6 is connected to the inside of the body 1 via two rectilinear segments 7 and 8 for thereafter facilitating a deformation of the corrugations 9 when the tubular body 1 has to be closed at its lower portion.

The wall 6 is provided in such a manner as to extend to the top of the neck 3 which is closed by a plate 10 in which are formed ports 11 and 12 opening on either side of the wall 6 in compartments 13 and 14 which are defined by the wall 6 inside a body 1.

The assembly of the body 1 and wall 6 is produced preferably by injection of a thermoplastics resin, and care is taken to conform the mold used so that the wall 6 does not present any sharp angles but, on the contrary defines a succession of rounded elements, including the zone thereof joining together the rectilinear segments.

The compartments 13 and 14 are filled with the products which they have to contain before closing the bottom portion 15 of the tubular body 1.

Figure 4:
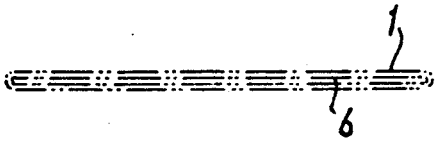
FIG. 4 is a cross-sectional view taken along line IV—IV of FIG. 2.

Closing of the bottom portion 15 is made by means conventional in the art, and for example the bottom portion 15 is clamped and heated in order to provide a tight closing, the bottom portion 15 becoming then linear as shown in phantom lines in FIG. 2 and according to the cross-sectional view of FIG. 4. The closing of the bottom portion 15 can also be made by a crimping process.

Since the developed length of the wall 6 is equal to the half perimeter of the body 1, the closing operation made by clamping and heating, or by crimping of the bottom portion 15 is such that the wall 6 is flattened and sandwiched between the two corresponding portions of the body 1, which are in turn flattened as shown in FIG. 4.

It is advantageous that the ports 11 and 12 are closed by protrusions or other specific means provided in the closing plug, these means being preferably designed so as to always correspond one with the port 11 and the other with the port 12.

Thus, it is possible to fill the compartments 13 and 14 with products which should not get mixed or brought in contact together prior to use, as may be the case for example of a resin and its hardener, or also for body treatment products such as cosmetic products, in which the mixture of the two products has to be effected only at the moment of use.

The container described in the foregoing disclosure is particularly adapted to production by injection molding of a plastics material. However, in order to practice this process, the mold should be provided so as to cooperate with a slit core over its whole height in order to allow formation of the wall 6. It is important to this end that the mold should be provided with blockage means of the ends of the core for avoiding its deformation at the moment of injection. For facilitating an extraction from the mold, the core slit has a thickness which is progressively increasing toward the blockage means.

The invention is not limited to the embodiment shown and described in detail since various modifications may be carried out thereto without departing from its scope as shown by the appendant claims. In particular, the wall 6 can be corrugated only on a portion of its length. Likewise, the extent of the corrugations 9 may decrease from the bottom portion 15 up to the neck 3.

What is claimed is:

1. A deformable tubular container having outer curved tube-forming walls forming a tubular body; an inner longitudinal deformable, an imperforate corrugated partition-forming wall rigidly connected to opposite sides of said outer walls to define distinct, sealed, laterally-spaced compartments inside the tubular body, said corrugated partition-forming wall when expanded to eliminate the corrugations thereof having an overall width at least comparable to the corresponding dimension of the inner surface of said outer walls so it can be flattened against said inner surface, one end of said tubular body being collapsed and flattened around the corresponding flattened, corrugated end of said partition-forming wall to form a flattened, sealed end of the tubular body, and wherein said partition forming wall has a thickness which decreases towards said one end.

2. The container as set forth in claim 1, wherein the container has a neck at the end opposite said one end and wherein the longitudinal wall extends over the entire length of the container, said neck being closed by an end wall having ports respectively communicating with each of said distinct compartments.

3. The container as set forth in claim 2, further comprising a closing cap selectively closing the ports.

4. The tubular container of claim 1 wherein said partition-forming wall is corrugated for its full length.

5. The container as set forth in claim 1, wherein said corrugated partition-forming wall is provided with corrugations, said corrugations having an extent increasing toward said one end.

* * * * *